US008744293B2

(12) United States Patent
Shirasaki et al.

(10) Patent No.: US 8,744,293 B2
(45) Date of Patent: Jun. 3, 2014

(54) IMAGE FORMING APPARATUS CONFIGURED TO PERFORM A LIGHT ADJUSTMENT OPERATION AND METHOD FOR CONTROLLING IMAGE FORMING APPARATUS

(75) Inventors: Yoshinori Shirasaki, Osaka (JP); Tatsuya Miyadera, Osaka (JP); Tomohiro Ohshima, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 244 days.

(21) Appl. No.: 13/064,887

(22) Filed: Apr. 25, 2011

(65) Prior Publication Data

US 2011/0268461 A1 Nov. 3, 2011

(30) Foreign Application Priority Data

Apr. 28, 2010 (JP) ..... 2010-103687

(51) Int. Cl.
*G03G 15/043* (2006.01)

(52) U.S. Cl.
USPC ..... 399/45

(58) Field of Classification Search
USPC ..... 399/45, 389
See application file for complete search history.

(56) References Cited

U.S. PATENT DOCUMENTS

| | | | | |
|---|---|---|---|---|
| 4,124,295 | A * | 11/1978 | Gardiner | 355/68 |
| 6,291,829 | B1 * | 9/2001 | Allen et al. | 250/559.07 |
| 6,400,912 | B1 * | 6/2002 | Tanaka et al. | 399/45 |
| 6,433,329 | B1 * | 8/2002 | Butka et al. | 250/221 |
| 6,900,449 | B2 * | 5/2005 | Bolash et al. | 250/559.16 |
| 2008/0019749 | A1 * | 1/2008 | Suzuki | 399/389 |
| 2009/0034998 | A1 * | 2/2009 | Omata | 399/45 |

FOREIGN PATENT DOCUMENTS

| | | | | |
|---|---|---|---|---|
| JP | 04080739 | A * | 3/1992 | G03B 27/72 |
| JP | 2003043772 | A | 2/2003 | |
| JP | 2005242093 | A | 9/2005 | |
| JP | 2008273094 | A | 11/2008 | |
| JP | 2008299311 | A | 12/2008 | |
| JP | 2009008898 | A | 1/2009 | |
| JP | 2009122138 | A | 6/2009 | |
| JP | 2009180947 | A | 8/2009 | |
| JP | 2009258426 | A | 11/2009 | |
| JP | 2010008904 | A | 1/2010 | |

(Continued)

OTHER PUBLICATIONS

Abstract of JP 2005-242093 published Sep. 8, 2005.

(Continued)

*Primary Examiner* — Clayton E Laballe
*Assistant Examiner* — Victor Verbitsky
(74) *Attorney, Agent, or Firm* — Harness, Dickey & Pierce, P.L.C.

(57) ABSTRACT

An image forming apparatus includes: a photosensitive element; a writing light source; a conveying unit; a light-emitting unit; a detection unit; a writing control unit; and an adjustment unit. The detection unit detects reflected light from a recording medium. The writing control unit controls the writing light source based on operational timing when a signal output from the detection unit turns to a fixed threshold. The adjustment unit acquires information of a gloss level of the recording medium, and adjusts light emission intensity of the light-emitting unit according to the acquired information of the gloss level in such a manner that a signal output from the detection unit when the light-emitting unit irradiates a plain region of the recording medium approximates a certain reference value.

16 Claims, 14 Drawing Sheets

(56) References Cited

FOREIGN PATENT DOCUMENTS

| | | | |
|---|---|---|---|
| JP | 2010048906 | A | 3/2010 |
| JP | 2010191255 | A | 9/2010 |
| JP | 2011-059623 | | 3/2011 |

OTHER PUBLICATIONS

Abstract of JP 2010-008904 published Jan. 14, 2010.
Abstract of JP 2008-273094 published Nov. 13, 2008.
Abstract of JP 2009-122138 published Jun. 4, 2009.
Abstract of JP 2009-258426 published Nov. 5, 2009.
Abstract of JP 2010-048906 published Mar. 4, 2010.
Abstract of JP 2010-191255 published Sep. 2, 2010.
Abstract of JP 2009-180947 published Aug. 13, 2009.
Abstract of JP 2009-008898 published Jan. 15, 2009.
Abstract of JP 2003-043772 published Feb. 14, 2003.
Abstract of JP 2008-299311 published Dec. 11, 2008.

* cited by examiner

| SHEET TYPE | DRIVING POWER SETTING VALUE | |
|---|---|---|
| REGULAR PAPER | A | |
| RECYCLED PAPER | B | ... |
| PHOTO PAPER | C | |
| | ⋮ | |

| SHEET TRAY | DRIVING POWER SETTING VALUE | |
|---|---|---|
| TRAY 1 | A | |
| TRAY 2 | B | ... |
| TRAY 3 | C | |
| | ⋮ | |

IMAGE FORMING APPARATUS CONFIGURED TO PERFORM A LIGHT ADJUSTMENT OPERATION AND METHOD FOR CONTROLLING IMAGE FORMING APPARATUS

CROSS-REFERENCE TO RELATED APPLICATIONS

The present application claims priority to and incorporates by reference the entire contents of Japanese Patent Application No. 2010-103687 filed in Japan on Apr. 28, 2010.

BACKGROUND OF THE INVENTION

1. Field of the Invention

The present invention relates to an image forming apparatus and a method for controlling the image forming apparatus.

2. Description of the Related Art

Recently, computerization of information has been promoted. In the computerization, image processing apparatuses, such as printers and facsimiles used for outputting computerized information and scanners used for computerizing documents, have become indispensable. Such image processing apparatuses are mostly structured as multifunction peripherals that can be used as printers, facsimiles, scanners, and copying machines with image capturing, image forming, and communications functions, for example, provided therein.

Among the image processing apparatuses, electrophotography image forming apparatuses have been widely used as the image forming apparatuses used for outputting computerized documents. In an example of such electrophotography image forming apparatuses, a photosensitive element is exposed to light so as to generate a static latent image, and then the static latent image is developed by using a developer such as toner to generate a toner image, and lastly paper output is carried out by transferring the toner image onto a sheet.

In such electrophotography image forming apparatus, operational timing of exposing the photosensitive element to light to generate a static latent image and operational timing of sheet conveyance are adjusted to be synchronized so as to generate an image in a desired area on a sheet. In an image forming apparatus that forms a color image by using a plurality of photosensitive elements, which is known as a tandem type image forming apparatus, exposure timing among color photosensitive elements is adjusted so that images developed on the respective color photosensitive elements are accurately overlapped. Hereinafter, these adjustment processes are collectively referred to as positional deviation correction.

In the positional deviation correction, a timing detection pattern serving as an adjustment image is formed in the same operation as normal operation of photosensitive element exposure and static latent image development, and then the pattern is read by a reflective light sensor. A period from when photosensitive element exposure starts to when the timing detection pattern is read is counted. The counted period is compared with a predetermined reference value, and adjustment processing is carried out based on the difference between the counted period and the reference value.

The timing detection pattern is formed on an intermediate transfer belt in an image forming apparatus employing an intermediate transfer belt system in which a toner image is transferred onto the intermediate transfer belt from a photosensitive element, and thereafter transferred onto a sheet. The timing detection pattern is formed on a conveying belt conveying a sheet in an image forming apparatus employing a direct transfer system in which a toner image is directly transferred onto the sheet from a photosensitive element. In an image forming apparatus having no intermediate belt or no conveying belt, i.e., an image forming apparatus employing a beltless system, a method is proposed in which a position adjustment pattern is printed on a conveyed sheet. For example, refer to Japanese Patent Application Laid-open No. 2008-299311.

In positional deviation correction, a sensor that reads a timing detection pattern irradiates a surface of a sheet on which the timing detection pattern is formed, and receives reflected light from the surface of the sheet so as to detect the pattern based on a voltage of a signal obtained according to a received light amount. The voltage obtained according to reflected light shows a maximum in reflected light from a white region in which no pattern is formed. In a region in which the pattern is formed, a light amount of reflected light decreases because the pattern absorbs the light, and thus the voltage lowers. Accordingly, the pattern can be detected by detecting a change from a reference voltage that is set to a voltage obtained based on the reflected light from the region in which no pattern is formed.

In the positional deviation correction, a driving voltage or a driving current that drives a light source included in the sensor is adjusted according to a fluctuation in the light source or a fluctuation in a gloss level of the white region, in order to obtain a constant reference voltage. The adjustment is carried out to prevent the white region from being wrongly detected as the region in which the pattern is formed due to weak reflected light from the irradiated white region when the white region has a low gloss level or the light source has a low light amount.

In an image forming apparatus including an intermediate transfer belt or a conveying belt, the intermediate transfer belt or the conveying belt is used as the white region. In other words, a driving voltage or a driving current is adjusted in such a manner that a voltage obtained according to reflected light from a surface of the intermediate transfer belt or the conveying belt becomes a predetermined value. The adjustment of a driving voltage or current that drives the light source is carried out mainly to address a fluctuation in a gloss level of the white region, i.e., the intermediate transfer belt or the conveying belt, caused by stains thereon.

In the beltless system, however, the above-described adjustment of a driving voltage or current that drives the light source is not carried out because the white region corresponds to a sheet newly conveyed, and thus it is not necessary to take stains into consideration unlike the case with the other systems (intermediate transfer system and direct transfer system).

Recently, types of sheets, including recycled paper and photo paper, which are used for image forming output in addition to regular paper have increased. Even in the beltless system, a pattern may be wrongly detected in positional deviation correction as described above, because different types of sheets have different gloss levels. Accordingly, the adjustment of a driving voltage or current of a light source as described above is also desired in the beltless system.

As describe above, in the beltless system, positional deviation correction is carried out by using a positional deviation correction pattern formed on a conveyed sheet. In sheet conveyance of the beltless system, a sheet is more likely to be undulated than a sheet conveyed on a conveying belt by being sucked to the belt. The undulation of a sheet causes a distance between a light source and a reflecting surface to fluctuate, resulting in intensity of detected reflected light being fluctuated. The coincidental occurrence of sheet undulation and a gloss level fluctuation of a sheet surface further increases a likelihood that a pattern is wrongly detected in the beltless system.

SUMMARY OF THE INVENTION

It is an object of the present invention to at least partially solve the problems in the conventional technology.

According to an aspect of the present invention an image forming apparatus, includes: a photosensitive element; a writing light source that irradiates the photosensitive element with a light beam so as to write a static latent image on the photosensitive element; a conveying unit that conveys a recording medium on which an image corresponding to the written static latent image is formed; a light-emitting unit that irradiates the recording medium conveyed by the conveying unit with a predetermined light emission intensity; a detection unit that detects reflected light from the recording medium, the reflected light varying according to an adjustment image formed on the recording medium, and outputs a signal corresponding to intensity of the detected reflected light; a writing control unit that controls the writing light source based on operational timing when the signal output from the detection unit turns to a fixed threshold; and an adjustment unit that acquires information of a gloss level of the recording medium, and adjusts light emission intensity of the light-emitting unit according to the acquired information of the gloss level in such a manner that a signal output from the detection unit when the light-emitting unit irradiates a plain region of the recording medium approximates a certain reference value.

According to another aspect of the present invention a method for controlling an image forming apparatus that includes a writing light source that irradiates a photosensitive element with a light beam so as to write a static latent image on the photosensitive element and forms an image corresponding to the written static latent image on a recording medium conveyed by a conveying unit, the method includes: irradiating, with a light-emitting unit, the recording medium conveyed by the conveying unit with certain light emission intensity; detecting, with a detection unit, reflected light from the recording medium, the reflected light varying according to an adjustment image formed on the recording medium, and outputting a signal corresponding to intensity of the detected reflected light; controlling, with a writing control unit, operational timing when the writing light source emits the light beam based on operational timing when the signal output from the detection unit turns to a fixed threshold; and acquiring, with an adjustment unit, information of a gloss level of the recording medium, and adjusting light emission intensity of the light-emitting unit according to the acquired information of the gloss level in such a manner that a signal output from the detection unit when the light-emitting unit irradiates a plain region of the recording medium approximates a certain reference value.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 10B illustrates a change of a detection signal with the passage of time;

DETAILED DESCRIPTION OF THE PREFERRED EMBODIMENTS

First Embodiment

A first embodiment of the present invention will be described in detail below with reference to the accompanying drawings. In the first embodiment, an MFP (multifunction peripheral) is described as an example of an image forming apparatus. The MFP according to the first embodiment is an image forming apparatus having no conveying belt (hereinafter, such no conveying belt system is referred to as a beltless system). The image forming apparatus employing a beltless system can prevent a correction pattern from being wrongly detected in image writing position correction carried out by an optical writing device that forms a static latent image on a photosensitive element.

Figure 1:
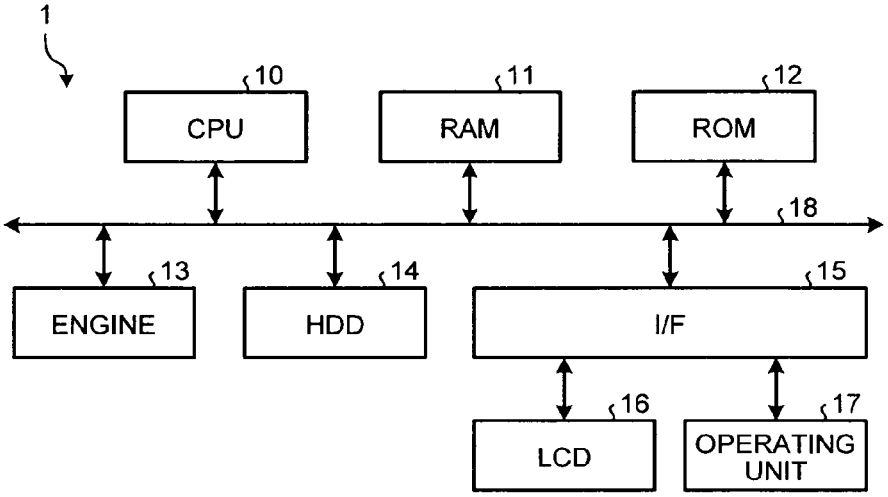
FIG. 1 is a block diagram illustrating a hardware structure of an image forming apparatus according to a first embodiment of the present invention.

FIG. 1 is a block diagram illustrating a hardware structure of an MFP 1 according to the first embodiment. As illustrated in FIG. 1, the MFP 1 according to the first embodiment includes an engine that executes image forming, in addition to a structure same as an information processing apparatus such as a common server and a personal computer (PC). The MFP 1 according to the first embodiment includes a central processing unit (CPU) 10, a random access memory (RAM) 11, a read only memory (ROM) 12, an engine 13, a hard disk drive (HDD) 14, and an interface I/F 15 that are connected through a bus 18. A liquid crystal display (LCD) 16 and an operating unit 17 are connected with the I/F 15.

The CPU 10 is a calculation unit, and controls operation of the whole of the MFP 1. The RAM 11 is a volatile storage medium that can read and write information at a high speed, and used by the CPU 10 as a working region when processing information. The ROM 12 is a read-only non-volatile storage medium, and stores therein programs as firmware. The engine 13 is a mechanism that actually executes image forming in the MFP 1.

The HDD 14 is a non-volatile storage medium into or from which information can be written or read, and stores therein an operating system (OS), various types of control programs, and application programs, for example. The I/F 15 connects the bus 18 with various types of hardware and networks, for example, and controls them. The LCD 16 is a visual user interface with which a user confirms a state of the MFP 1. The operating unit 17 is a user interface, such as a keyboard and a mouse, with which a user inputs information to the MFP 1.

In the hardware structure, a program stored in the ROM 12, the HDD 14, or a recording medium (not illustrated) such as an optical disk is read out to the RAM 11, and operated under control of the CPU 10 so as to form a software control unit. A functional block that realizes functions of the MFP 1 according to the first embodiment is structured by combining the software control unit thus formed and the hardware.

Figure 2:
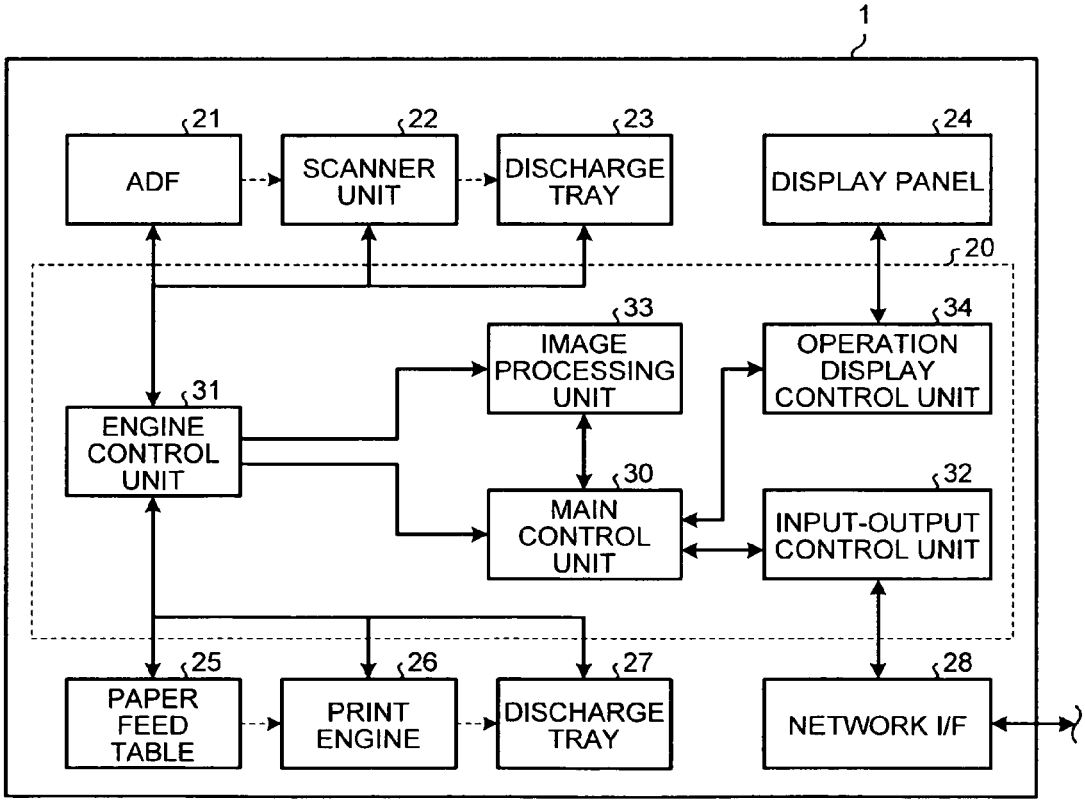
FIG. 2 is a schematic illustrating a functional structure of the image forming apparatus according to the first embodiment.

The functional structure of the MFP 1 according to the first embodiment will be described below with reference to FIG. 2. FIG. 2 is a block diagram illustrating the functional structure of the MFP 1 according to the first embodiment. As illustrated in FIG. 2, the MFP 1 according to the first embodiment includes a controller 20, an ADF (automatic document feeder) 21, a scanner unit 22, a discharge tray 23, a display panel 24, a paper feed table 25, a print engine 26, a discharge tray 27, and a network I/F 28.

The controller 20 includes a main control unit 30, an engine control unit 31, an input-output control unit 32, an image processing unit 33, and an operation display control unit 34. As illustrated in FIG. 2, the MFP 1 according to the first embodiment is structured as a multifunction peripheral including the scanner unit 22 and the print engine 26. In FIG. 2, arrows of solid line represent electrical connection while arrows of broken line represent sheet flow.

The display panel 24 is an output interface that visually displays a state of the MFP 1, and is also an input interface (operating unit) used as a touch panel through which a user directly operates the MFP 1 or inputs information into the MFP 1. The network I/F 28 is an interface between the MFP 1 and other apparatuses so as to communicate each other through a network. The examples of the interface used in the network I/F 28 include an Ethernet (registered trademark) interface and USB (universal serial bus) interface.

The controller 20 is structured by combining software and hardware. Specifically, the controller 20 is structured with a software control unit and hardware such as integrated circuits. The software control unit is formed by operating a control program such as firmware stored in the ROM 12, a non-volatile memory, the HDD 14, or a non-volatile recording medium such as an optical disk, under control of the CPU 10 after the control program is loaded into a volatile memory (hereinafter, referred to as a memory) such as the RAM 11. The controller 20 functions as a control unit that controls the whole of the MFP 1.

The main control unit 30 plays a role of controlling each component included in the controller 20, and sends commands to each component of the controller 20. The engine control unit 31 plays a role of a driving unit that controls or drives the print engine 26 and the scanner unit 22, for example. The input-output control unit 32 inputs signals and commands input through the network I/F 28 to the main control unit 30. The main control unit 30 controls the input-output control unit 32 so as to access other apparatuses through the network I/F 28.

The image processing unit 33 generates drawing information based on print information included in an input print job, according to the control of the main control unit 30. The drawing information is information for the print engine 26 serving as an image forming unit to draw images to be formed in image forming operation. The print information included in a print job is image information that is converted by a printer driver installed in an information processing apparatus such as PC into a format that the MFP 1 can recognize. The operation display control unit 34 displays information on the display panel 24, or notifies the main control unit 30 of information input through the display panel 24.

When the MFP 1 operates as a printer, first the input-output control unit 32 receives a print job through the network I/F 28. The input-output control unit 32 transfers the received print job to the main control unit 30. Upon receiving the print job, the main control unit 30 controls the image processing unit 33 to generate drawing information based on print information included in the print job.

When the drawing information is generated by the image processing unit 33, the engine control unit 31 executes image forming on a sheet conveyed from the paper feed table 25 based on the generated drawing information. In other words, the print engine 26 functions as an image forming unit. The documents on which images are formed by the print engine 26 are discharged to the discharge tray 27.

When the MFP 1 operates as a copying machine, the image processing unit 33 generates drawing information based on image capturing information that the engine control unit 31 receives from the scanner unit 22 or image information generated by the image processing unit 33. The engine control unit 31 controls the print engine 26 based on the drawing information in the same manner as the printer operation.

Figure 3:
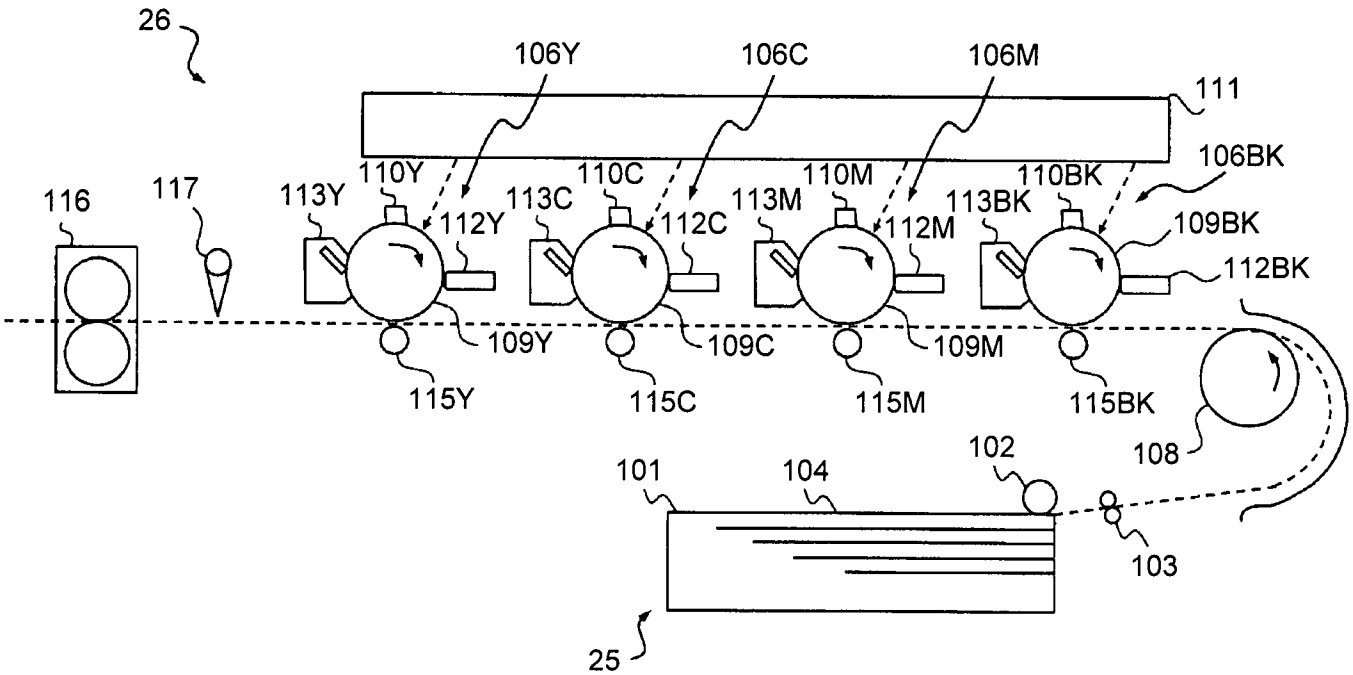
FIG. 3 is a schematic illustrating a structure of a print engine according to the first embodiment.

The structure of the print engine 26 according to the first embodiment will be described below with reference to FIG. 3, next. As illustrated in FIG. 3, the print engine 26 according to the first embodiment is an engine known as a tandem type engine, and includes image forming units 106 for respective colors arranged along a conveying path of a sheet (recording sheet) 104. The sheet 104 is separated from the sheets 104 in a paper feed tray 101 and fed by a paper feeding roller 102 and a pair of separation rollers 103. The conveying path of the sheet 104 is indicated with the broken line in FIG. 3. The image forming units 106 (electrophotography processing units), which specifically are image forming units 106BK, 106M, 106C, and 106Y, are arranged along the conveying path in this order from an upstream side of a conveying direction.

The image forming units 106BK, 106M, 106C, and 106Y are merely different in color of images to form from each other, but have the same internal structure. The image forming unit 106BK forms images of black; the image forming unit 106M forms images of magenta; the image forming unit 106C forms images of cyan; and the image forming unit 106Y forms images of yellow. The following description is made specifically with respect to the image forming unit 106BK. The descriptions of the image forming units 106M, 106C, and 106Y are omitted because they have the same internal structure as the image forming unit 106BK, as described above. The elements same as those of the image forming unit 106BK in the image forming units 106M, 106C, and 106Y are labeled with respective suffixes of M, C, and Y instead of BK in the image forming unit 106BK in FIG. 3.

In the conveying path of the sheet 104, the sheet 104 is conveyed by other rollers (not illustrated) in addition to the paper feeding roller 102 and a carriage roller 108 that are illustrated in FIG. 3. In other words, the MFP 1 according to the first embodiment is an image forming apparatus employing a beltless system in which a sheet is conveyed without using a belt. In image forming, the sheet 104 is sequentially fed from the uppermost one of the sheets 104 housed in the paper feed tray 101, and conveyed by the carriage roller 108 to the image forming unit 106BK serving as the first image forming unit, in which a toner image of black is transferred onto the sheet 104.

The image forming unit 106BK includes a photosensitive drum 109BK serving as a photosensitive element, and a charging unit 110BK, an optical writing device 111, a developing unit 112BK, a photosensitive cleaner (not illustrated), and a neutralization unit 113BK that are disposed around the photosensitive drum 109BK. The optical writing device 111 irradiates the photosensitive drums 109BK, 109M, 109C, and 109Y (hereinafter, collectively referred to as a "photosensitive drum 109") with laser beams.

In image forming, an outer circumferential surface of the photosensitive drum 109BK is uniformly charged by the charging unit 110BK in darkness. Thereafter, the outer circumferential surface of the photosensitive drum 109BK is subjected to writing by the optical writing device 111 with a laser beam corresponding to an image of black so as to form a static latent image. The developing unit 112BK makes the static latent image visible with black toner. As a result, a toner image of black is formed on the photosensitive drum element 109BK.

The toner image is transferred onto the sheet 104 by a function of a transfer roller 115BK at a position where the photosensitive drum 109BK and the sheet 104 conveyed along the conveying path are abutted (transfer position). As a result of the transfer, an image is formed on the sheet 104 with black toner. After the completion of toner image transfer, the photosensitive drum 109BK is subjected to cleaning by the photosensitive element cleaner so as to remove unnecessary toner remaining on the outer circumferential surface, and thereafter is neutralized by the neutralization unit 113BK so as to stand ready to form a subsequent image. In the structure, the photosensitive drum 109BK and the transfer roller 115BK function also as carriage rollers to convey a sheet.

The sheet 104 on which a black toner image is transferred by the image forming unit 106BK in this way is conveyed along the conveying path to the image forming unit 106M serving as a subsequent image forming unit. In the image forming unit 106M, a magenta toner image is formed on the photosensitive drum 109M and the toner image is transferred so as to overlap with the black toner image formed on the sheet 104 by the same image forming processing as the image forming unit 106BK.

The sheet 104 is further conveyed to the image forming units 106C and 106Y in this order. In the image forming unit 106C, a cyan toner image formed on the photosensitive drum 109C is transferred so as to overlap with the toner images formed on the sheet 104. In the image forming unit 106Y, a yellow toner image formed on the photosensitive drum 109Y is transferred so as to overlap with the toner images formed on the sheet 104. As a result, a full-color image is formed on the sheet 104. The sheet 104 on which a full-color image is formed by overlapping the respective color images is subjected to fixing processing by a fixing unit 116 disposed at an end of the conveying path. After the full-color image is fixed, the sheet 104 is externally discharged from the MFP 1.

In the MFP 1, the toner images of the respective colors may be not overlapped at positions at which they should be overlapped, resulting in positional deviations being caused among the respective color images due to the following errors: positional error in inter-axis distance among the photosensitive drums 109BK, 109M, 109C, and 109Y, error in parallelism among the photosensitive drums 109BK, 109M, 109C, and 109Y, setting error of deflection mirrors in the optical writing device 111, and timing error in writing static latent images on the photosensitive drums 109BK, 109M, 109C, and 109Y.

In addition, an image may be transferred to another area beyond an area where the image should be transferred onto a sheet serving as a transfer target due to the same causes as described above. As main factors of such positional deviation, a skew, a registration shift in a sub-scanning direction, magnification error in a main-scanning direction, and a registration shift in the main-scanning direction, for example, are known. Errors in the rotational speed of a carriage roller conveying a sheet and conveyance amount errors due to wear of the carriage roller are also known.

In order to correct such positional deviation, a pattern detection sensor 117 is provided. The pattern detection sensor 117 is an optical sensor that reads positional deviation correction patterns transferred onto the sheet 104 by the photosensitive drums 109BK, 109M, 109C, and 109Y, and includes a light-emitting element that irradiates the correction patterns drawn on a surface of the sheet 104 and a light receiving element that receives reflected light from the correction patterns. As illustrated in FIG. 3, the pattern detection sensor 117 is disposed downstream from the photosensitive drums 109BK, 109M, 109C, and 109Y, and supported along a direction perpendicular to the conveying direction of the sheet 104 on a board on which the photosensitive drums 109BK, 109M, 109C, and 109Y are disposed. The pattern detection sensor 117 and positional deviation correction are described in detail later.

Figure 4:
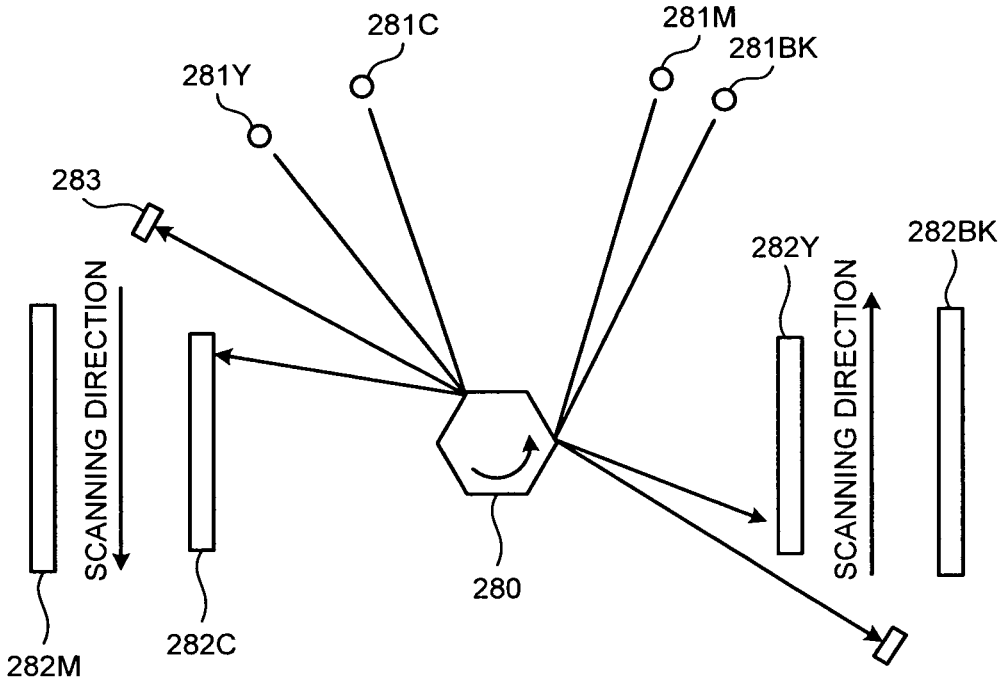
FIG. 4 is a top view illustrating an optical writing device according to the first embodiment.
Figure 5:
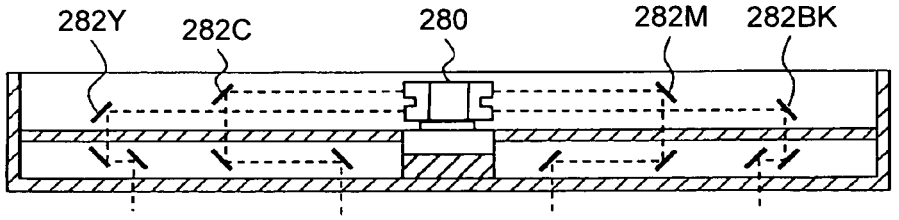
FIG. 5 is a side sectional view illustrating the structure of the optical writing device according to the first embodiment.

The optical writing device 111 according to the embodiment is described below. FIG. 4 is a top view of the first optical writing device 111 according to the first embodiment. FIG. 5 is a side sectional view of the optical writing device 111 according to the first embodiment. As illustrated in FIGS. 4 and 5, light source units 281BK, 281M, 281C, and 281Y (hereinafter, collectively referred to as a "light source unit 281") irradiate the respective photosensitive drums 109BK, 109M, 109C, and 109Y with laser beams for writing. The light source unit 281 according to the first embodiment is composed of a semiconductor laser, a collimator lens, a slit, a prism, a cylinder lens, for example.

A laser beam emitted from the light source unit 281 is reflected by a reflecting mirror 280. The respective laser beams are guided by an optical system (not illustrated) including fθ lens to respective mirrors 282BK, 282M, 282C, and 282Y (hereinafter, collectively referred to as a "mirror 282"), and thereafter enter a subsequent optical system so as to scan the surfaces of the respective photosensitive drums 109BK, 109M, 109C, and 109Y.

The reflecting mirror 280 is a hexahedral polygon mirror. The reflecting mirror 280 rotates and can scan one line in the main-scanning direction with a laser beam reflected by one face of the polygon mirror. In the optical writing device 111 according to the first embodiment, scanning is carried out by two sets of the two light source units and one reflecting surface of the reflecting mirror 280: one reflecting surface of the reflecting mirror 280 and the light source units 281BK and 281M, and another reflecting surface of the reflecting mirror 280 and the light source units 281C and 281Y. Because of the structure, which is more compact than that of a system that carries out scanning by using one reflection surface alone, the optical writing device 111 can carry out writing to the four photosensitive drums simultaneously.

In addition, a horizontal synchronization detection sensor 283 is disposed in a vicinity of a scanning start position of a region scanned by the reflecting mirror 280 with a laser beam. Upon receiving a laser beam emitted from the light source unit 281, the horizontal synchronization detection sensor 283 detects scanning timing of the scanning start position of a main-scanning line so that a control unit that controls the light source unit 281 and the reflecting mirror 280 are synchronized.

Figure 6:
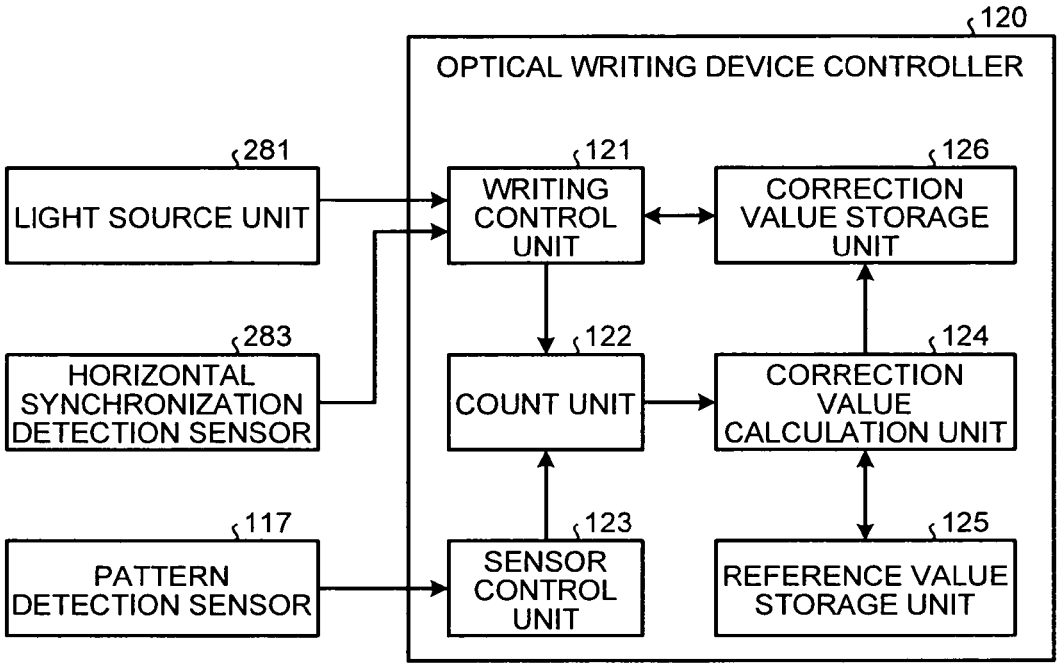
FIG. 6 is a block diagram illustrating a control unit of the optical writing device according to the first embodiment.

A control block of the optical writing device 111 according to the first embodiment will be described below with reference to FIG. 6. FIG. 6 is a schematic illustrating a functional structure of an optical writing device controller 120 that controls the optical writing device 111 according to the first embodiment, and a relationship among the optical writing device controller 120, the light source unit 281, the horizontal synchronization detection sensor 283, and the pattern detection sensor 117.

As illustrated in FIG. 6, the optical writing device controller 120 according to the first embodiment includes a writing control unit 121, a count unit 122, a sensor control unit 123, a correction value calculation unit 124, a reference value storage unit 125, and a correction value storage unit 126. The optical writing device 111 according to the first embodiment includes an information processing system composed of the CPU 10, the RAM 11, the ROM 12, and the HDD 14, for example, in the same manner as described with reference to FIG. 1. The optical writing device controller 120 illustrated in FIG. 6 is structured by a control program that is stored in the ROM 12 or the HDD 14 and loaded in the RAM 11, and thereafter operated under control of the CPU 10 in the same manner as the controller 20 of the MFP 1.

The writing control unit 121 controls the light source unit 281 serving as a writing light source based on image information input from the engine control unit 31 of the controller 20 in response to a synchronization detection signal of the horizontal synchronization detection sensor 283. The writing control unit 121 drives the light source unit 281 so as to draw a positional deviation correction pattern in positional deviation correction processing described above, in addition to driving the light source unit 281 based on image information input from the engine control unit 31. A correction value generated as a result of positional deviation correction processing is stored in the correction value storage unit 126 illustrated in FIG. 6. The writing control unit 121 corrects operational timing of driving the light source unit 281 based on the correction value stored in the correction value storage unit 126.

In the positional deviation correction processing, the count unit 122 starts counting at the same time when the writing control unit 121 controls the light source unit 281 to start to expose the photosensitive drum 109BK to light. The count unit 122 stops counting when the sensor control unit 123 detects a pattern based on an output signal of the pattern detection sensor 117.

In this way, the count unit 122 functions as a detection period count unit in the positional deviation correction processing. The detection period count unit counts a detection period from when the writing control unit 121 controls the light source unit 281 to start exposing the photosensitive drum 109BK to when the pattern detection sensor 117 detects a positional deviation correction pattern. In addition, the count unit 122 counts each detection timing of patterns continuously drawn in positional deviation correction processing to correct deviations among respective color toner images.

The sensor control unit 123 controls the pattern detection sensor 117. The sensor control unit 123 determines that a positional deviation correction pattern formed on the sheet 104 reaches a position where the pattern detection sensor 117 detects the pattern, based on the output signal of the pattern detection sensor 117 as described above. When determining that the positional deviation correction pattern reaches the detection position of the pattern detection sensor 117, the sensor control unit 123 inputs a detection signal to the count unit 122.

In addition, the sensor control unit 123 controls the pattern detection sensor 117 so as to adjust a light amount of a light-emitting element included in the pattern detection sensor 117. In other words, the sensor control unit 123 functions also as an adjustment unit.

As for such adjustment, an image forming apparatus including an intermediate transfer belt or a conveying belt carries out the following adjustment: a surface of the intermediate transfer belt or the conveying belt on which nothing is drawn (plain belt) is irradiated with light, and a driving current or a driving voltage (hereinafter, referred to as "driving power") of a light source of a pattern detection sensor is adjusted in such a manner that a voltage generated by the pattern detection sensor by receiving reflected light from the surface becomes a predetermined value.

In such image forming apparatus, a section corresponding to the sensor control unit 123 of the first embodiment increases the driving power of a light-emitting element of the light source and carries out the same processing again if an output signal value of a light receiving element of the sensor is smaller than a predetermined target value. In contrast, if the output signal value of the light receiving element of the sensor is larger than the predetermined target value, the section corresponding to the sensor control unit 123 of the first embodiment decreases the driving power of the light-emitting element of the light source and carries out the same processing again. In general light amount adjustment operation, the driving power of a light-emitting element is adjusted by repeating such processing so that an output signal achieves a target value, resulting in an irradiation light amount of the light-emitting element being adjusted to a proper level.

The MFP 1 according to the first embodiment is an image forming apparatus employing a beltless system without using an intermediate transfer belt or a conveying belt. Therefore, the MFP 1 cannot carry out adjustment processing in which the driving power is adjusted based on reflected light from a surface of a plain intermediate transfer belt or a plain conveying belt after the surface is irradiated with light. The present invention, however, can realize light amount adjustment of the pattern detection sensor 117 of the MFP 1, which is an image forming apparatus employing a beltless system.

Figure 7:
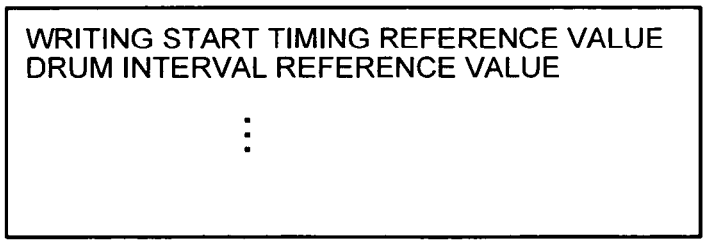
FIG. 7 is a schematic illustrating information stored in a reference value storage unit according to the first embodiment.

The correction value calculation unit 124 calculates a correction value based on a counting result of the count unit 122 and a reference value stored in the reference value storage unit 125. In other words, the correction value calculation unit 124 functions as a reference value acquisition unit and a correction value calculation unit. FIG. 7 illustrates examples of the reference value stored in the reference value storage unit 125. As illustrated in FIG. 7, the reference value storage unit 125 stores therein a writing start timing reference value and a drum interval reference value.

The writing start timing reference value is a reference value of a period from when the writing control unit 121 controls the light source unit 281 to start exposing the photosensitive drum 109BK to when the pattern detection sensor 117 detects a positional deviation correction pattern. In other words, the correction value calculation unit 124 compares a writing start count value out of count values of the count unit 122 with the writing start timing reference value, and calculates a correction value based on the difference therebetween.

The drum interval reference value is a reference value of detection timing of each pattern continuously drawn as described above. In other words, the correction value calculation unit 124 compares a drum interval count value out of count values of the count unit 122 with the drum interval count reference value, and calculates a correction value based on the difference therebetween. The correction values thus calculated are stored in the correction value storage unit 126 as described above. The correction values are stored in the correction value storage unit 126 in this way, enabling the writing control unit 121 to drive the light source unit 281 with reference to the correction values. In other words, the writing control unit 121 functions as a writing control unit that controls the light source unit 281 serving as a writing light source based on operational timing when a signal output from the pattern detection sensor 117 serving as a detection unit turns to a predetermined threshold.

Figure 8:
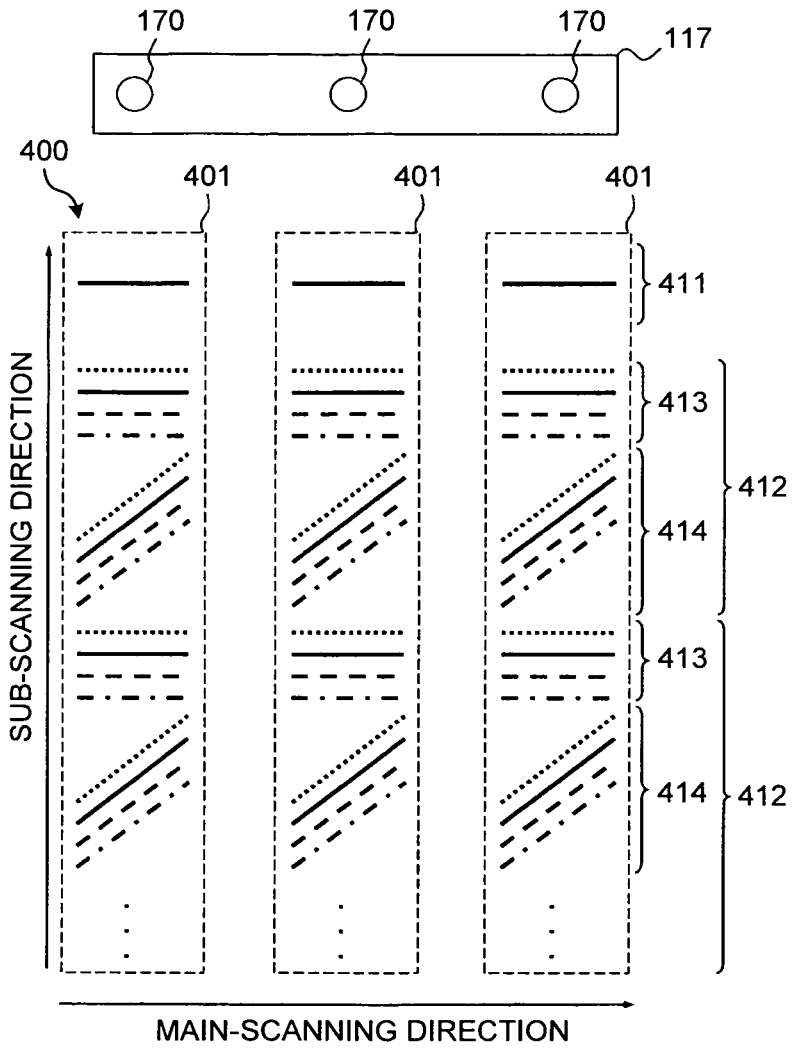
FIG. 8 is a schematic illustrating an example of a pattern drawn in positional deviation correction operation according to the first embodiment.

Positional deviation correction operation according to the first embodiment will be described below with reference to FIG. 8. FIG. 8 is a schematic illustrating a mark (hereinafter, referred to as a "positional deviation correction mark") drawn on the sheet 104 by the light source unit 281 controlled by the writing control unit 121 in the positional deviation correction operation according to the first embodiment. As illustrated in FIG. 8, a positional deviation correction mark 400 according to the first embodiment includes positional deviation correction pattern rows 401 each of which has various patterns arranged in the sub-scanning direction and that are arranged in a plurality of rows (three in the first embodiment) in the main-scanning direction. In FIG. 8, a pattern drawn by the photosensitive drum 109BK is indicated with the solid line, one drawn by the photosensitive drum 109Y is indicated with the dot-line, one drawn by the photosensitive drum 109C is indicated with the broken line, and one drawn by the photosensitive drum 109M is indicated with the dot-dash-dot line.

As illustrated in FIG. 8, the pattern detection sensor 117 includes a plurality of (three in the first embodiment) sensor elements 170 in the main-scanning direction. Each of the positional deviation correction pattern rows 401 is drawn at a position that corresponds to one of the sensor elements 170. Because of the arrangement, the optical writing device controller 120 can detect patterns at a plurality of positions in the main-scanning direction, and improve accuracy of positional deviation correction operation by averaging the detection results of the plurality of positions.

As illustrated in FIG. 8, the positional deviation correction pattern row 401 includes a start position correction pattern 411 and a drum interval correction pattern 412. In addition, the drum interval correction pattern 412 is repeatedly drawn as illustrated in FIG. 8. The start position correction pattern 411 is drawn for counting the writing start count value. The start position correction pattern 411 is also used for the sensor control unit 123 to correct detection timing when the sensor control unit 123 detects the drum interval correction pattern 412.

The start position correction pattern 411 according to the first embodiment is the solid line transferred from the photosensitive drum 109BK in parallel with the main-scanning direction as illustrated in FIG. 8. In start position correction using the start position correction pattern 411, the optical writing device controller 120 carries out correction operation of writing start timing based on a read signal of the start position correction pattern 411 by the pattern detection sensor 117. In other words, a writing start timing reference value stored in the reference value storage unit 125 is a reference value of a period from when the light source unit 281 starts to draw a black pattern by the photosensitive drum 109BK in the start position correction pattern 411 to when the pattern detection sensor 117 reads the drawn black pattern and the sensor control unit 123 detects the pattern.

The drum interval correction pattern 412 is a pattern drawn for counting the drum interval count value, as the name indicates. As illustrated in FIG. 8, the drum interval correction pattern 412 includes a sub-scanning direction correction pattern 413 and a main-scanning direction correction pattern 414. The optical writing device controller 120 carries out positional deviation correction of each of the photosensitive drums 109BK, 109M, 109C, and 109Y in the sub-scanning direction based on a read signal of the sub-scanning direction correction pattern 413 by the pattern detection sensor 117 while the optical writing device controller 120 carries out positional deviation correction of each of the photosensitive drums 109BK, 109M, 109C, and 109Y in the main-scanning direction based on a read signal of the main-scanning direction correction pattern 414 by the pattern detection sensor 117.

In other words, the drum interval reference value stored in the reference value storage unit 125 is a reference value of a period from when the light source unit 281 starts to draw the drum interval correction pattern 412 under the control of the writing control unit 121 to when the pattern detection sensor 117 reads lines included in the drawn drum interval correction pattern 412 and the sensor control unit 123 detects the lines.

The optical writing device controller 120 drives a conveying mechanism including the carriage roller 108 so as to discharge the sheet when positional deviation correction using the positional deviation correction mark 400 illustrated in FIG. 8 is carried out and completed.

Figure 9:
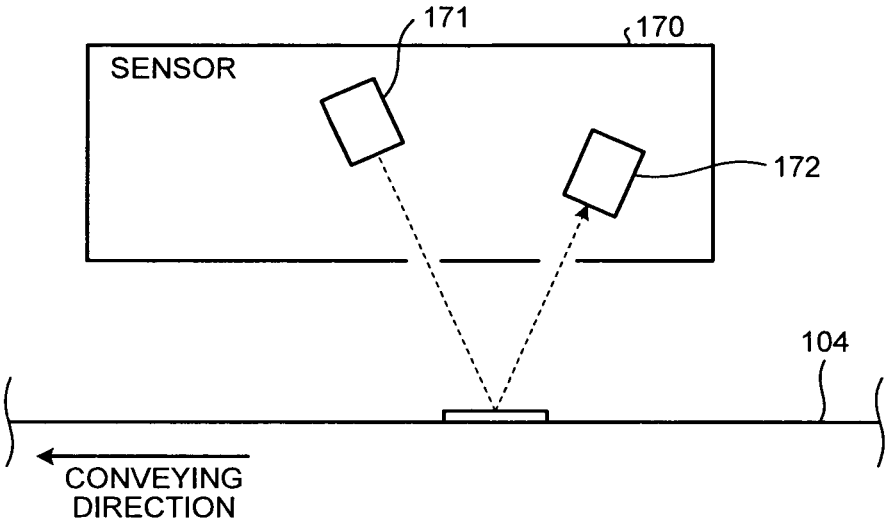
FIG. 9 is a schematic illustrating pattern detection according to the first embodiment.

A pattern detection principle by the sensor element 170 included in the pattern detection sensor 117 is described below with reference to FIG. 9. FIG. 9 is a side sectional view schematically illustrating the structure of the sensor element 170 according to the first embodiment and a state when the sensor element 170 detects a pattern. FIG. 9 illustrates a section that is perpendicular to the main-scanning direction and includes therein the sensor element 170.

As illustrated in FIG. 9, the sensor element 170 according to the first embodiment includes a light-emitting element 171 and a specular reflection light receiving element 172. The light-emitting element 171 is a light source serving as a confirmation target of an irradiation light amount in the first embodiment, and functions as a light-emitting unit. The light-emitting element 171 according to the first embodiment is structured with an LED light source that emits a light beam.

The specular reflection light receiving element 172 is a light receiving unit that receives reflected light from a surface on which the positional deviation correction mark 400 is formed, i.e., a surface of the sheet, and which is irradiated by the light-emitting element 171. As illustrated in FIG. 9 with the dot-line, the specular reflection light receiving element 172 is disposed in such a position at such an angle that specular reflection light of light reflected on the surface of the sheet after being emitted by the light-emitting element 171 enters the specular reflection light receiving element 172.

Figure 10A:
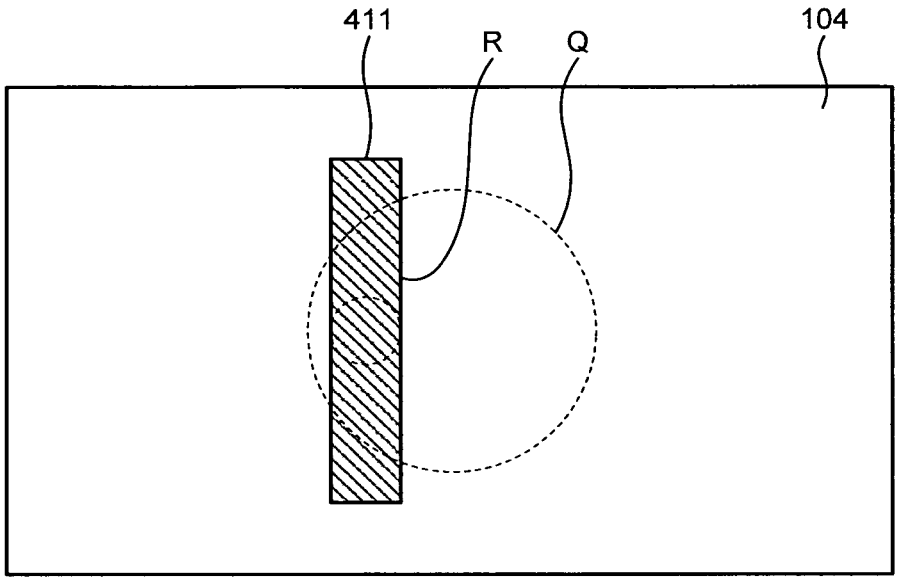
FIGS. 10A and 10B are schematics illustrating the pattern detection according to the first embodiment.
Figure 10B:
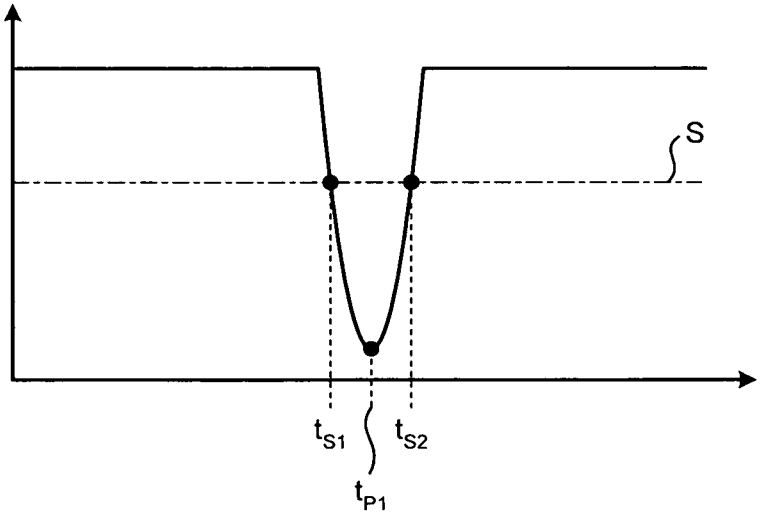

A relationship between the positional deviation correction pattern according to the first embodiment and a detection signal output from the pattern detection sensor 117, and a method for confirming a light amount are described below with reference to FIGS. 10A and 10B FIG. 10A is a top view of the sheet 104, and illustrates the start position correction pattern 411 drawn by the photosensitive drum 109BK on the sheet 104. In FIG. 10A, a spot Q of a laser beam emitted by the light-emitting element 171 and a spot R of reflected light received by the specular reflection light receiving element 172 are each indicated with a broken line circle.

FIG. 10B illustrates an output signal of the specular reflection light receiving element 172 when the surface of the sheet 104 illustrated in FIG. 10A is irradiated with light. As illustrated in FIG. 10B, signal intensity is flat during irradiation on white background because specular reflection light is detected. When the pattern reaches the spot R, the signal intensity starts to fall because a specular reflection light component starts to decrease. The specular reflection light component becomes a minimum and the signal intensity falls to a bottom value (i.e., a minimum) at operational timing when the center of the pattern reaches the center of the spot R. In this way, the specular reflection light receiving element 172 included in the sensor element 170 of the pattern detection sensor 117 functions as a detection unit that detects reflected light from a sheet serving as a recoding medium and outputs a signal corresponding to the intensity of the detected reflected light.

As illustrated in FIG. 10B, a threshold S is set for the output signal of the specular reflection light receiving element 172. The threshold S is stored by the sensor control unit 123. The sensor control unit 123 detects two pieces of operational timing when the output signal of the specular reflection light receiving element 172 becomes the threshold S, and determines reach timing of the pattern based on an average of the two pieces of operational timing, when detecting the pattern in positional deviation correction.

For example, when detecting the start position correction pattern 411 in FIG. 10B, the sensor control unit 123 detects reach timing of the start position correction pattern 411 based on an average of operational timing $t_{S1}$ and operational timing $t_{S2}$. Instead of using the threshold S, operational timing $t_{P1}$ at which the signal intensity falls to the bottom value as illustrated in FIG. 10B may be used as the reach timing of the pattern.

Figure 11A:
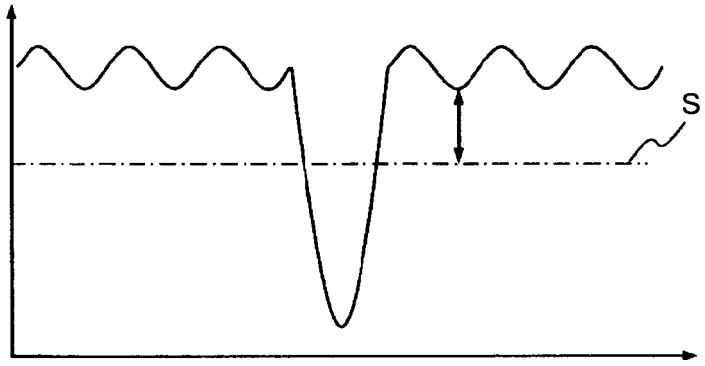
FIGS. 11A and 11B are schematics illustrating fluctuation of detection signal in pattern detection according to the first embodiment.
Figure 11B:
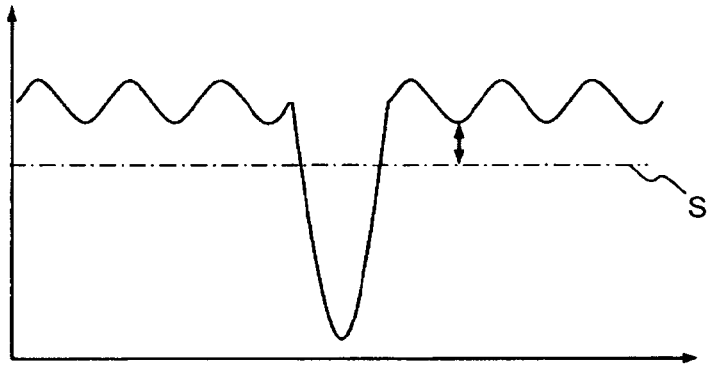

Problems to be solved by the first embodiment will be described below with reference to FIGS. 11A and 11B. As illustrated in FIG. 10B, the signal intensity is flat during the irradiation on white background because specular reflection light is detected. Practically, the signal intensity, however, fluctuates due to behavior of a sheet. Specifically, a sheet is undulated when being conveyed because the sheet is directly conveyed by the carriage roller in the image forming apparatus employing a beltless system. As a result, a distance fluctuates between the sheet that reflects a laser beam and the specular reflection light receiving element 172 that receives reflected light from the sheet, causing the fluctuation of the signal intensity. FIGS. 11A and 11B illustrate the fluctuation of the signal intensity as described above.

The fluctuation of signal intensity as illustrated in FIGS. 11A and 11B increases the likelihood that the pattern is wrongly detected because a margin between the signal intensity during the irradiation on white background and the threshold S decreases. FIG. 11B illustrates an exemplary case of a sheet having a lower gloss level than that of a sheet of FIG. 11A. As illustrated in FIG. 11B when a sheet has a low gloss level, the overall level of the output signal is weakened because a light amount of light that is reflected on the surface of the sheet 104 and enters the specular reflection light receiving element 172 decreases. As a result, a margin between the signal intensity during the irradiation on white background and the threshold S further decreases. In addition, if the signal intensity fluctuates due to the behavior of the sheet, the likelihood that the pattern is wrongly detected further increases. It is a problem to be solved by the first embodiment to prevent the pattern from being wrongly detected caused by the decrease in the margin as described above.

The image forming apparatus of the first embodiment can maintain the margin between the signal intensity during the irradiation on white background and the threshold S illustrated in FIGS. 11A and 11B by adjusting a light amount of the light-emitting element 171 included in the pattern detection sensor 117 in the positional deviation correction operation. The adjustment operation (hereinafter, referred to as "light amount adjustment operation") of the light amount of the light-emitting element 171 included in the pattern detection sensor 117 will be described below.

Figure 12:
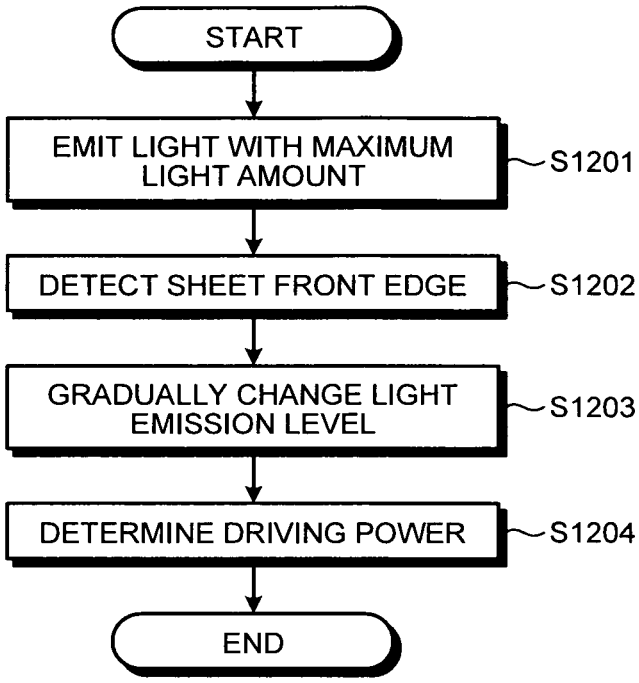
FIG. 12 is a flowchart illustrating light amount adjustment operation according to the first embodiment.
Figure 13:
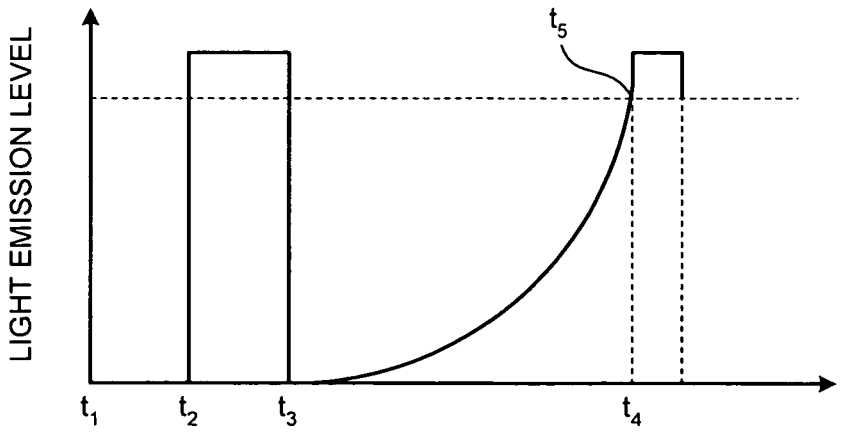
FIG. 13 is a schematic illustrating a detection signal of a sensor in the light amount adjustment operation according to the first embodiment.

FIG. 12 is a flowchart illustrating the light adjustment operation according to the first embodiment. FIG. 13 is a schematic illustrating a detection signal of the pattern detection sensor 117 in the light amount adjustment operation. The light amount adjustment operation according to the first embodiment is executed by the sensor control unit 123 in positional deviation correction. In the first embodiment, the sensor control unit 123 executes the light amount adjustment operation before the writing control unit 121 starts to draw the positional deviation correction mark as illustrated in FIG. 8. As illustrated in FIG. 12, once the light adjustment operation starts, the carriage roller 108 starts to convey a sheet on which a positional deviation correction mark is to be drawn. The sensor control unit 123 causes the light-emitting element 171 included in the pattern detection sensor 117 to emit light at a maximum light amount (S1201).

When the light-emitting element 171 emits light at S1201 ($t_1$ in FIG. 13), no reflected light enters the specular reflection light receiving element 172 because the sheet does not yet reach an irradiation point of the light-emitting element 171. The detection signal of the pattern detection sensor 117, thus, does not change. In a state in which the sheet does not yet reach the detection position of the pattern detection sensor 117 as $t_1$ illustrated in FIG. 13, it is necessary to prevent light reflected by other areas inside the apparatus from entering the specular reflection light receiving element 172. Parts facing the pattern detection sensor 117 are, thus, preferably formed in a color having low reflectance. Specifically, they are preferably formed in black or a color having low brightness and chroma similar to black. Examples of the color having low brightness and chroma include brown, gray, and navy-blue.

Thereafter, when the front edge of the conveyed sheet reaches the irradiation point of the light-emitting element 171, light emitted by the light-emitting element 171 is reflected on the surface of the sheet and reflected light enters the specular reflection light receiving element 172. When receiving reflected light, the pattern detection sensor 117 outputs a detection signal having intensity corresponding to an mount of light emitted from the light-emitting element 171

($t_2$ in FIG. 13). As a result, the sensor control unit 123 detects that the front edge of the sheet reaches the irradiation point of the light-emitting element 171 (S1202).

When detecting the front edge of the sheet at S1202, the sensor control unit 123 reduces the light emission level of the light-emitting element 171 to zero ($t_3$ in FIG. 13), and thereafter gradually increases the light emission level from zero to a maximum (S1203). In processing at S1203 the sensor control unit 123 gradually increases the driving power that drives the light-emitting element 171 from zero so as to change the light emission level of the light-emitting element 171 from zero to the maximum. Consequently, the detection signal of the pattern detection sensor 117 gradually increases from zero (from $t_3$ to $t_4$ in FIG. 13).

In processing at S1203, the sensor control unit 123 stores therein the driving power of the light-emitting element 171 at operational timing when the detection signal of the pattern detection sensor 117 becomes a predetermined reference voltage ($t_5$ in FIG. 13). After the completion of processing at S1203, the sensor control unit 123 determines the driving power stored at S1203 as the driving power of the light-emitting element 171 in positional deviation correction (S1204), and the light amount adjustment ends. The light amount adjustment of the light-emitting element 171 is completed in this way. Then, the writing control unit 121 executes positional deviation correction by way of drawing a positional deviation correction mark.

The reference voltage is a voltage of the detection signal output from the specular reflection light receiving element 172 when receiving reflected light from a plain region of the sheet, and is set to a value having a sufficient margin from the threshold S described with reference to FIGS. 11A and 11B. The problem explained using FIGS. 11A and 11B may be solved by adjusting a voltage of a detection signal that is output based on reflected light from a plain region of a sheet so as to reach a reference voltage having a sufficient margin with respect to the threshold S in this way.

As describe above, the optical writing device 111 according to the first embodiment executes light amount adjustment by detecting a sheet conveyed for positional deviation correction and using a surface of the sheet even though the image forming apparatus employs a beltless system. Consequently, a positional deviation correction pattern can be prevented from being wrongly detected in positional deviation correction operation on images formed by the image forming apparatus employing a beltless system.

Figure 14:
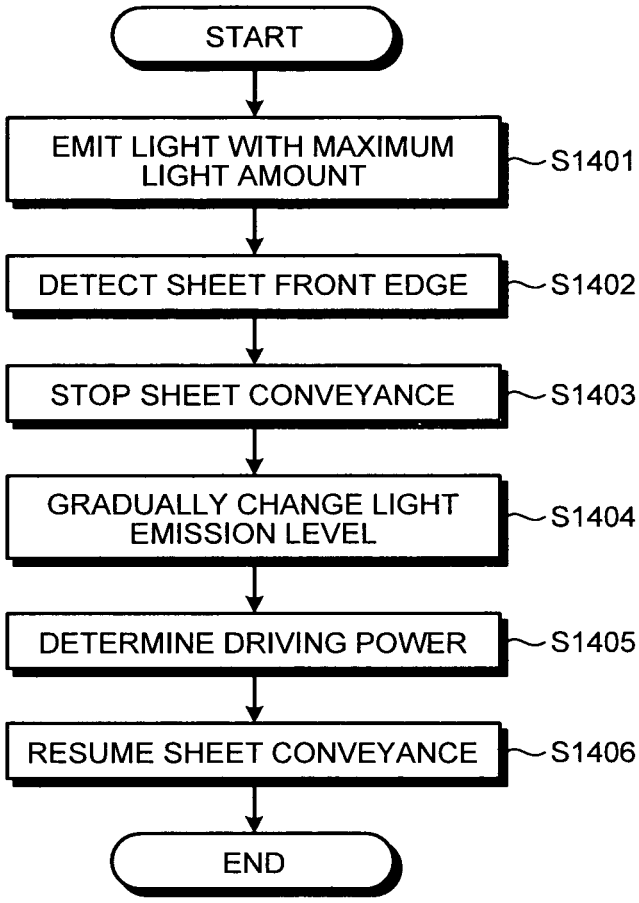
FIG. 14 is a flowchart illustrating the light amount adjustment operation according to the first embodiment.

FIG. 14 is a flowchart illustrating another example of light amount adjustment operation. In FIG. 14, operation from S1401 to S1402 is the same as that from S1201 to S1202. When' detecting the front edge of a sheet at S1402, the optical writing device controller 120 controls the carriage roller 108 to stop conveyance of the sheet (S1403). Thereafter, the driving power of the light-emitting element 171 is determined by the same processing as S1203 and S1204 (S1404 and S1405).

When the driving power of the light-emitting element 171 is determined, the optical writing device controller 120 controls the carriage roller 108 so as to resume conveyance of the sheet (S1406), and the process is terminated. Subsequently, positional deviation correction is executed in the same manner as illustrated in FIG. 12. In the example illustrated in FIG. 14, the conveyance of the sheet is stopped during increasing the light emission level of the light-emitting element 171 from zero to a maximum by the sensor control unit 123 at S1404, therefore the fluctuation of signal intensity due to the undulation of a sheet described with reference to FIGS. 11A and 11B can be prevented. Consequently, the driving power of the light-emitting element 171 can be more accurately determined at S1405.

As described above, the optical writing device 111 included in the MFP 1 employing a beltless system according to the first embodiment conveys a sheet for positional deviation correction, draws the positional deviation correction mark 400 on the sheet, and executes positional deviation correction. The optical writing device 111 detects the front edge of the conveyed sheet, and adjusts a light amount of the light-emitting element 171 included in the pattern detection sensor 117 by using a front edge area, before executing the positional deviation correction. Consequently, patterns included in the positional deviation correction mark 400 can be prevented from being wrongly detected when being detected.

In the above-described first embodiment, light amount adjustment operation is carried out before positional deviation correction operation. The reason why light amount adjustment operation is executed is to deal with the fluctuation of gloss levels of sheets as described above. Therefore, no light amount adjustment operation is required if sheets set in the paper feed tray 101 remain unchanged after the latest light amount adjustment operation. Such case is described below with reference to FIG. 15.

Figures 15, 16:
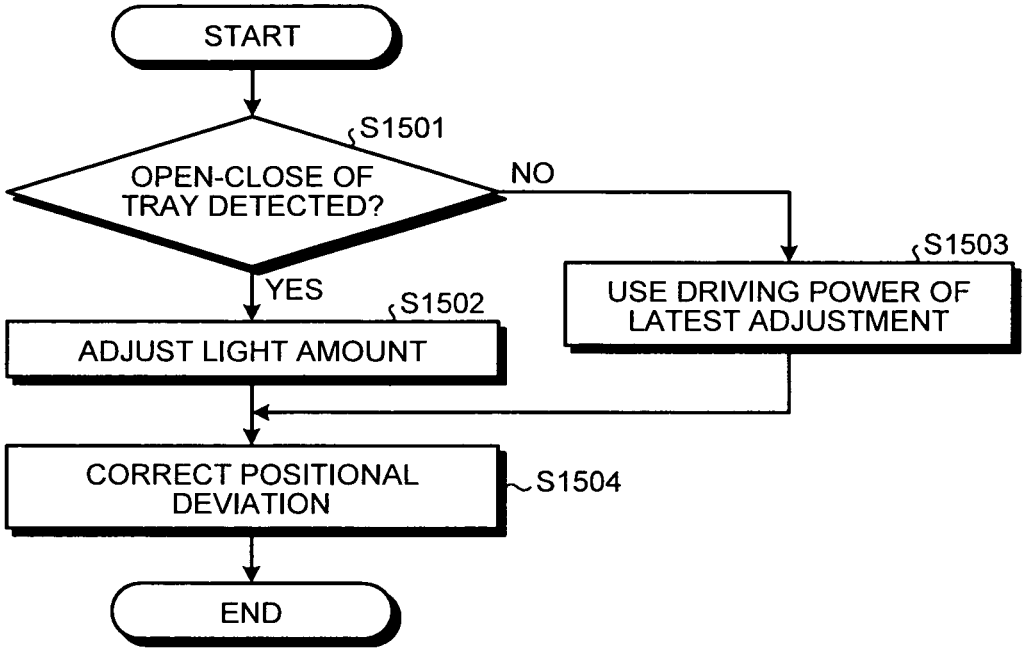
FIG. 15 is a flowchart illustrating positional deviation correction operation according to the first embodiment.
FIG. 16 illustrates an example of a driving power determination table according to a second embodiment of the present invention.

FIG. 15 is a flowchart illustrating the operation of the optical writing device controller 120 after positional deviation correction operation starts. As illustrated in FIG. 15, once the positional deviation correction operation starts, the optical writing device controller 120 confirms whether the paper feed tray 101 is opened after the completion of the latest light amount adjustment operation (S1501).

In an image forming apparatus according to the example of FIG. 15, flag information is stored when the paper feed tray 101 is opened and closed. At S1501, the optical writing device controller 120 determines whether the paper feed tray 101 is opened or closed with reference to the flag information. In other words, the optical writing device controller 120 functions as a housing open-close detection unit that detects the open-close of the paper feed tray 101 serving as a housing of a recording medium. The flag information is stored by the following manner: the engine control unit 31 detects the open-close of the paper feed tray 101, and stores the date and time. The engine control unit 31 is also required to deal with a case when sheets are replaced during power-off time of the MFP 1. In order to deal with the requirement, the paper feed table 25 is provided with a member whose state can be mechanically changed by the open-close of the paper feed tray 101, such as a rod-shaped member whose posture angle is changed by the open-close of the paper feed tray 101. The engine control unit 31 determines whether the paper feed tray 101 is opened during the power-off time by detecting the state of the member, and generates flag information.

When it is determined that the paper feed tray 101 is opened and closed at S1501 (YES at S1501), it is improper to use the driving power determined in the latest light amount adjustment operation because sheets housed in the paper feed tray 101 may have been replaced with sheets having a different gloss level from that of ones before replacement. Accordingly, the light amount adjustment operation described with reference to FIG. 12 or 14 is executed (S1502). The flag information is reset by execution of the light amount adjustment operation.

In contrast, when it is determined that the paper feed tray 101 is not opened and closed (NO at S1501), the sensor control unit 123 uses the driving power determined in the latest light amount adjustment operation because the sheets housed in the paper feed tray 101 remain unchanged, and the gloss level of the sheets is also unchanged (S1503). The value of the driving power determined in the latest light amount adjustment operation is stored by the sensor control unit 123.

After the completion of processing at S1502 or S1503, the writing control unit 121 starts to draw the positional deviation correction mark 400 so as to execute positional deviation correction operation (S1504). In the positional deviation correction operation, the light-emitting element 171 of the pattern detection sensor 117 is driven by the driving power determined at S1502 or S1503 so as to detect a pattern. The positional deviation correction operation is completed after above processing.

In the example of FIG. 15, if the paper feed tray 101 is not opened and closed after the completion of the latest light amount adjustment operation, the driving power determined in the latest light amount adjustment operation is used without executing light amount adjustment operation. Consequently, time taken from starting of positional deviation correction operation to completion of the operation can be reduced.

In the above first embodiment, the optical writing device employs a laser diode (LD) system as described with reference to FIG. 4. An optical writing device employing a light emitting diode (LED) system is also applicable in the same manner as the optical writing device employs the LD system because the optical writing device employing the LED system has the same adverse effect of the decrease in the margin as the optical writing device employs the LD system.

Second Embodiment

In the first embodiment, the driving power is adjusted based on a read signal of the pattern detection sensor 117. The objective of the processing is to adjust the driving power of the light-emitting element 171 included in the pattern detection sensor 117 according to a gloss level of a sheet. If the gloss level of a sheet can be determined, it is not necessary to actually irradiate a sheet with light and to determine a detection signal corresponding to reflected light from the sheet. In the second embodiment, the driving power of the light-emitting element 171 is determined without measuring reflected light, as described below.

The optical writing device controller 120 according to the second embodiment determines the driving power of the light-emitting element 171 according to a type of a sheet used in positional deviation correction operation and image forming output. Different types of sheets have different gloss levels as described above. However, the gloss level is almost the same in the same type of sheet. The types of sheets used for image forming output are limited to some extent, such as regular paper, recycled paper, photo paper, and gloss paper. Accordingly, preferable driving power can be determined by the following manner: a table (herein after, referred to as a "driving power determination table") is preliminary stored in which a type of a sheet and driving power are associated with each other, and preferable driving power is determined by acquiring information of a type of a sheet used in positional deviation correction.

FIG. 16 illustrates an example of the driving power determination table according to the second embodiment. As illustrated in FIG. 16, "sheet type" information and "driving power setting value" information are associated with each other in the driving power determination table. The sheet type information column in FIG. 16 represents types of sheets housed in the paper feed tray 101. The driving power setting value information column in FIG. 16 represents setting values of driving power of the light-emitting element 171 that corresponds to the respective type of sheets. The driving power determination table is prepared by a user in advance, and is stored in the sensor control unit 123.

Figure 17:
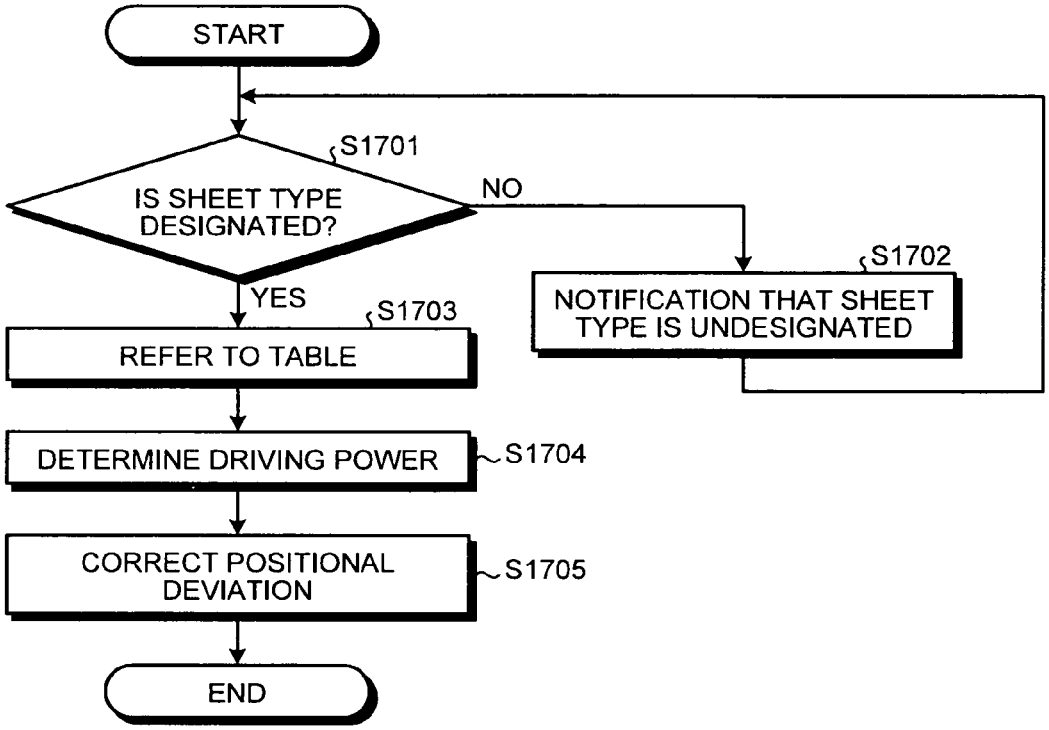
FIG. 17 is a flowchart illustrating positional deviation correction operation according to the second embodiment.

Operation of the optical writing device controller 120 will be described below with reference to FIG. 17. FIG. 17 is a flowchart illustrating the operation of the optical writing device controller 120 after positional deviation correction operation starts. As illustrated in FIG. 17, once the positional deviation correction operation starts, the optical writing device controller 120 determines whether a sheet type is determined by the user (S1701).

As describe above, the positional deviation correction operation is carried out at least before execution of image forming. A user can also designate a sheet type when image forming output is executed. The optical writing device controller 120, thus, determines a subsequent step with reference to a sheet type designated by a user, at S1701. The determination may also be done with reference to preset sheet type information representing types of sheets regularly used, in addition to above-described manner.

If it is determined that a sheet type is not designated at S1701, the optical writing device controller 120 notifies the engine control unit 31 of a sheet type being undesignated (S1702). The notification causes the main control unit 30 to recognize that a sheet type is undesignated through the engine control unit 31. The main control unit 30 controls the operation display control unit 34 to display a message promoting the user to designate a sheet type on the display panel 24.

If it is determined that a sheet type is designated at S1701, the optical writing device controller 120 refers to the designated sheet type and notifies the sensor control unit 123 of the designated sheet type (S1703). The sensor control unit 123 refers to the driving power determination table described with reference to FIG. 16, and determines the driving power according to the notified sheet type (S1704). In the second embodiment as described above, the sensor control unit 123 acquires information representing a sheet type as information relating to a gloss level of a sheet surface, and determines the driving power. Thereafter, the writing control unit 121 starts to draw the positional deviation correction mark 400, and positional deviation correction operation is executed (S1705). The positional deviation correction operation is completed after above processing.

Figure 18:
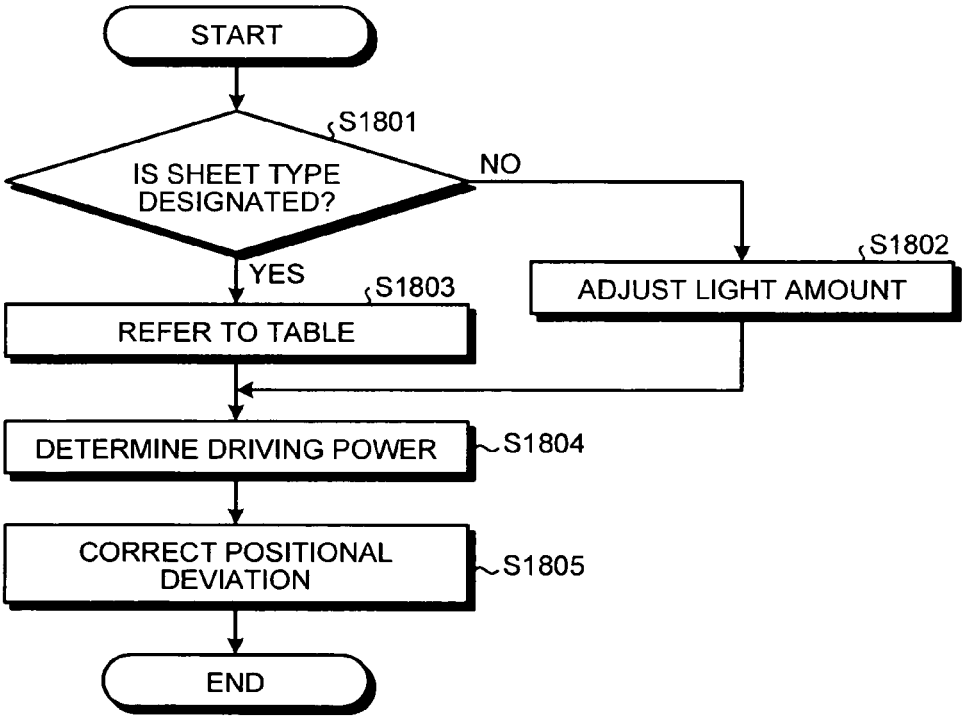
FIG. 18 is a flowchart illustrating the positional deviation correction operation according to the second embodiment.

FIG. 18 is a flowchart illustrating operation of the optical writing device controller 120 in a modified example of FIG. 17. In the example of FIG. 18, the optical writing device controller 120 determined whether a sheet type is designated in the same manner as S1701 (S1801). If a sheet type is designated (YES at S1801), processing is executed in the same manner as S1703 to S1705 of FIGS. 17 (S1803 to S1805).

In contrast, if a sheet type is not designated (NO at S1801), the sensor control unit 123 executes the light amount adjustment operation described with reference to FIG. 12 or 14 in the first embodiment (S1802), and then determines the driving power of the light-emitting element 171 (S1804). Thereafter, the writing control unit 121 starts to draw the positional deviation correction mark 400, and positional deviation correction operation is executed in the same manner as S1705 (S1805).

In the example of FIG. 18 as described above, if a sheet type is not designated, the light amount adjustment operation described in the first embodiment is executed without promoting a user to designate a sheet type by a message displayed on the display panel 24. The operation enables preferable driving power to be determined and positional deviation correction operation to be completed without requiring the user to input a sheet type.

A tray that houses therein sheets may be designated as an image forming output target when image forming output is executed depending on the specifications of the MFP 1. In this case, information representing a tray that houses therein sheets used for output is used as sheet type information. The driving power determination table represents information in which a tray used for output and driving power are associated with each other.

Figures 19, 20:
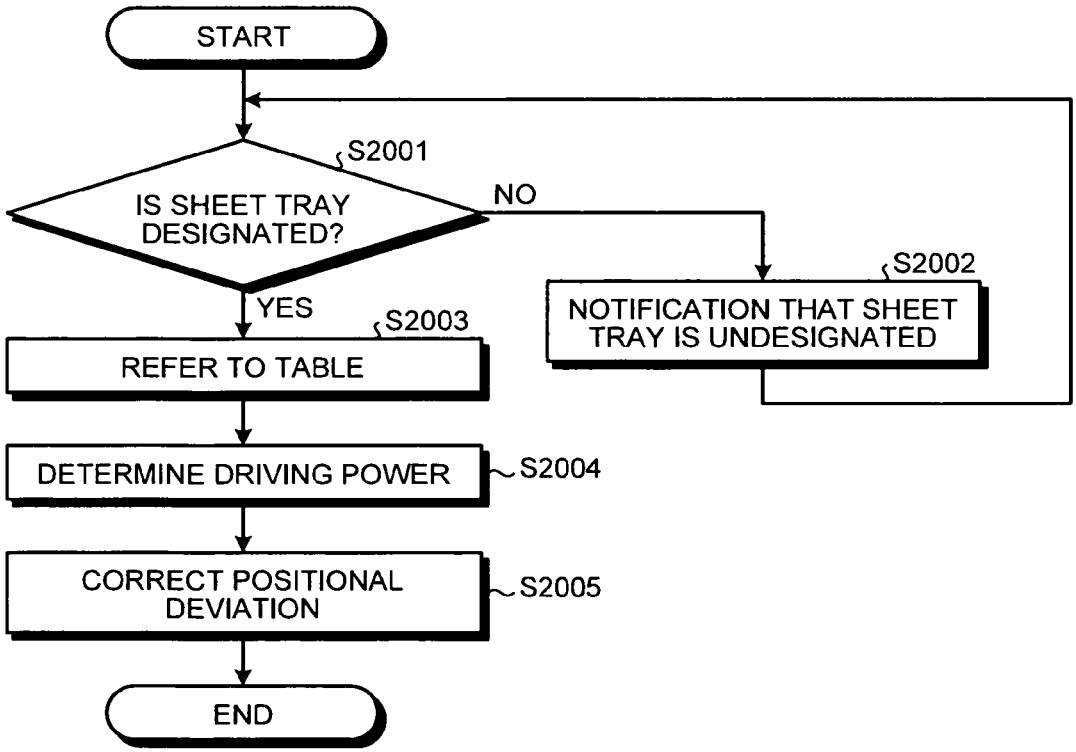
FIG. 19 illustrates an example of a driving power determination table according to the second embodiment.
FIG. 20 is a flowchart illustrating the positional deviation correction operation according to the second embodiment.

FIG. 19 illustrates an example of the driving power determination table in which a tray used for output and driving power are associated with each other. In the example of FIG. 19, numbers designating trays that houses therein sheets are stored instead of types of sheets. The driving power determination table illustrated in FIG. 19 is prepared by a user in advance and stored in the sensor control unit 123 in the same manner as the example described above.

Figure 21:
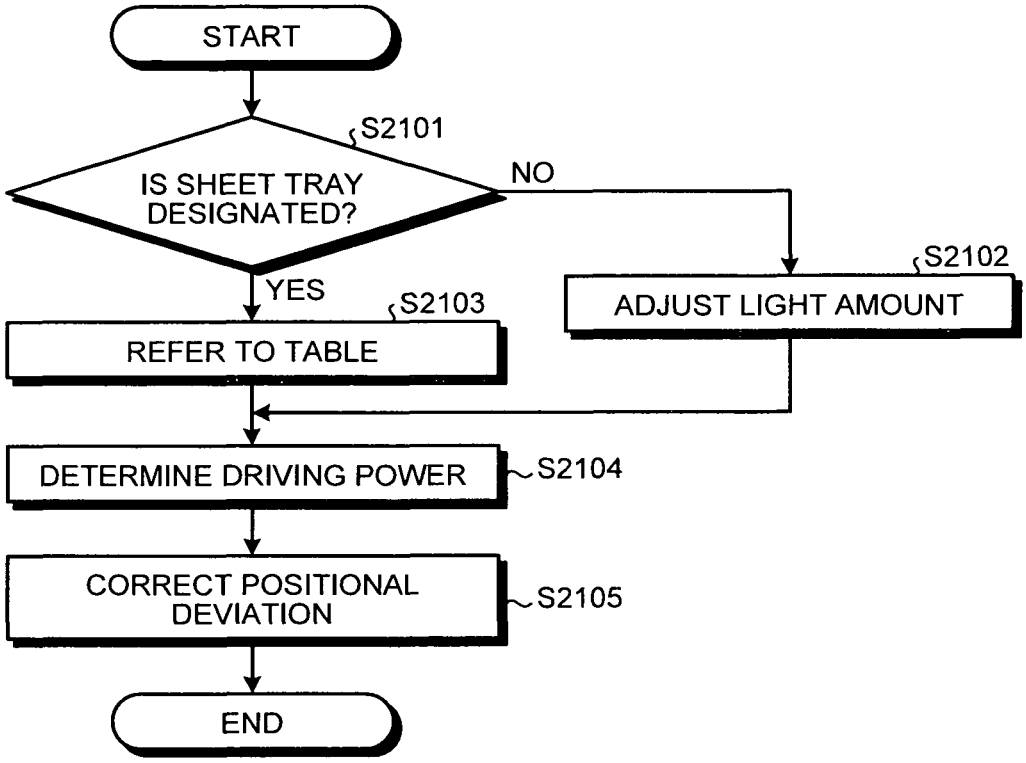
FIG. 21 is a flowchart illustrating the positional deviation correction operation according to the second embodiment.

FIGS. 20 and 21 are flowcharts each illustrating operation of the optical writing device controller 120 when a tray that houses therein sheets is designated in image forming output. FIG. 20 corresponds to FIG. 17 while FIG. 21 corresponds to FIG. 18. As illustrated in each of FIGS. 20 and 21, once the positional deviation correction operation starts, the optical writing device controller 120 determines whether the user designates a tray (S2001 and S2101).

In the example of FIG. 20, if a tray is not designated (NO at S2001), the optical writing device controller 120 notifies the engine control unit 31 of a tray being undesignated in the same manner as S1702 of FIG. 17 (S2002). In contrast, if a tray is not designated in the example of FIG. 21 (NO at S2101), the sensor control unit 123 executes the light amount adjustment operation in the same manner as S1802 of FIG. 18 (S2102). Operation of S2003 to S2005, and S2103 to S2105 is executed in the same manner as FIGS. 17 and 18.

As described above, the optical writing device 111 according to the second embodiment can determine preferable driving power without irradiating a conveyed sheet with light and measuring reflected light from the sheet, and can reduce time taken for light amount adjustment when positional deviation correction operation is executed.

The present invention can prevent an adjustment image from being wrongly detected in positional deviation correction operation of an image in an image forming apparatus that forms an image on a recording medium conveyed by a conveying unit corresponding to a static latent image written on a photosensitive element.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a photosensitive element;

a writing light source that irradiates the photosensitive element with a light beam for an exposure time so as to write a static latent image on the photosensitive element, the exposure time based on a result of a positional deviation correction operation;

a conveying unit that conveys a recording medium on which an image corresponding to the written static latent image is formed;

a light-emitting unit that during the positional deviation correction operation, irradiates the recording medium conveyed by the conveying unit with irradiated light at a set light emission intensity;

a detection unit that, detects reflected light from the recording medium when the light-emitting unit irradiates the recording medium with the irradiated light, an intensity of the reflected light varying according to an adjustment image formed on the recording medium, and outputs a signal corresponding to the intensity of the reflected light;

a writing control unit that controls the exposure time of the light beam irradiated on the photosensitive element by the writing light source based on operational timing when the signal output from the detection unit indicating that the intensity of the reflected light from the recording medium reaches a threshold; and an adjustment unit that, during an adjustment operation prior to the positional deviation correction operation, acquires information of a gloss level of the recording medium, and adjusts the light emission intensity of the irradiated light irradiated during the positional deviation correction operation by the light-emitting unit according to the acquired information of the gloss level in such a manner that a signal output from the detection unit when the light-emitting unit irradiates a plain region of the recording medium approximates a certain reference value, wherein the exposure time for the writing light source to irradiate the photosensitive element is determined based on the detection, during the positional deviation correction operation, of the reflected light on the adjustment image formed on the recording medium and the intensity of the reflected light is determined, during the adjustment operation prior to the positional deviation correction operation, based on the gloss level of the recording medium.

2. The image forming apparatus according to claim 1, wherein the adjustment unit causes the light-emitting unit to irradiate the plain region of the conveyed recording medium with the certain light emission intensity gradually changed, and acquires the information of the gloss level based on reflected light from the irradiated plain region.

3. The image forming apparatus according to claim 2, further comprising a housing open-close detection unit that detects an open-close of a housing that houses therein the recording medium, wherein the adjustment unit adjusts the light emission intensity of the light-emitting unit when the open-close of the housing is detected after a latest adjustment of the light emission intensity of the light-emitting unit.

4. The image forming apparatus according to claim 2, wherein the adjustment unit causes the light-emitting unit to irradiate the plain region of the recording medium with the certain light emission intensity gradually changed during a period when conveyance of the recording medium stops, and acquires the information of the gloss level based on reflected light from the irradiated plain region.

5. The image forming apparatus according to claim 2, further comprising a member that is disposed at a location facing the light-emitting unit and is formed in black or a color having low brightness and chroma similar to black, wherein the adjustment unit detects that the recording medium reaches the location facing the light-emitting unit based on reflected light from the recording medium, and causes the light-emitting unit to irradiate the plain region of the recording medium with the certain light emission intensity gradually changed.

6. The image forming apparatus according to claim 1, wherein the adjustment unit acquires the information of the gloss level based on information representing a type of the recording medium, and adjusts the light emission intensity of the light-emitting unit based on a recording medium type table in which the type of the recording medium and an adjustment value for adjusting the light emission intensity of the light-emitting unit are associated with each other.

7. The image forming apparatus according to claim 6, wherein the adjustment unit causes the light-emitting unit to irradiate the plain region of the recording medium with the certain light emission intensity gradually changed when the type of the recording medium is not designated, and acquires the information of the gloss level based on reflected light from the irradiated plain region.

8. The image forming apparatus according to claim 6, wherein the adjustment unit outputs a signal promoting designation of the type of the recording medium when the type of the recording medium is not designated.

9. A method for controlling an image forming apparatus that includes a writing light source that irradiates a photosensitive element with a light beam for an exposure time so as to write a static latent image on the photosensitive element and forms an image corresponding to the written static latent image on a recording medium conveyed by a conveying unit, the exposure time based on a result of a positional deviation correction operation, the method comprising:

irradiating, with a light-emitting unit, the recording medium conveyed by the conveying unit with irradiated light at a set light emission intensity during the positional deviation correction operation;

detecting, with a detection unit, reflected light from the recording medium when the light-emitting unit irridates the recording medium with the irradiated light, an intensity of the reflected light varying according to an adjustment image formed on the recording medium outputting, by the detection unit, a signal corresponding to the intensity of the reflected light;

controlling, with a writing control unit, the exposure time of the light being irradiated on the photosensitive element by the writing light source based on operational timing when the signal output from the detection unit indicating that the intensity of the reflected light from the recording medium turns to a reaches a threshold;

acquiring, with an adjustment unit, information of a gloss level of the recording medium; and adjusting the light emission intensity of the irradiated light irradiated during the positional deviation correction operation by the light-emitting unit according to the acquired information of the gloss level in such a manner that a signal output from the detection unit when the light-emitting unit irradiates a plain region of the recording medium approximates a certain reference value, wherein the exposure time for the writing light source to irradiate the photosensitive element is determined based on the detection, during the positional deviation correction operation, of the reflected light on the adjustment image formed on the recording medium and the intensity of the reflected light is determined, during the adjustment operation prior to the positional deviation correction operation, based on the gloss level of the recording medium.

10. The method for controlling an image forming apparatus according to claim 9, wherein the adjustment unit causes the light-emitting unit to irradiate the plain region of the conveyed recording medium with the certain light emission intensity gradually changed, and acquires the information of the gloss level based on reflected light from the irradiated plain region.

11. The method for controlling an image forming apparatus according to claim 10, further comprising, by a housing open-close detection unit, detecting an open-close of a housing that houses therein the recording medium, wherein the adjustment unit adjusts the light emission intensity of the light-emitting unit when the open-close of the housing is detected after a latest adjustment of the light emission intensity of the light-emitting unit.

12. The method for controlling an image forming apparatus according to claim 10, wherein the adjustment unit causes the light-emitting unit to irradiate the plain region of the recording medium with the certain light emission intensity gradually changed during a period when conveyance of the recording medium stops, and acquires the information of the gloss level based on reflected light from the irradiated plain region.

13. The method for controlling an image forming apparatus according to claim 10, wherein the adjustment unit detects that the recording medium reaches a location facing the light-emitting unit based on reflected light from the recording medium, and causes the light-emitting unit to irradiate the plain region of the recording medium with the certain light emission intensity gradually changed.

14. The method for controlling an image forming apparatus according to claim 9, wherein the adjustment unit acquires the information of the gloss level based on information representing a type of the recording medium, and adjusts the light emission intensity of the light-emitting unit based on a recording medium type table in which the type of the recording medium and an adjustment value for adjusting the light emission intensity of the light-emitting unit are associated with each other.

15. The method for controlling an image forming apparatus according to claim 14, wherein the adjustment unit causes the light-emitting unit to irradiate the plain region of the recording medium with the certain light emission intensity gradually changed when the type of the recording medium is not designated, and acquires the information of the gloss level based on reflected light from the irradiated plain region.

16. The method for controlling an image forming apparatus according to claim 14, wherein the adjustment unit outputs a signal promoting designation of the type of the recording medium when the type of the recording medium is not designated.

* * * * *